US005642825A

United States Patent [19]

Wohlgemuth

[11] Patent Number: 5,642,825

[45] Date of Patent: Jul. 1, 1997

[54] CONTAINER CLOSURE HAVING PERIPHERAL TAMPER-INDICATOR

[75] Inventor: Emanuel Erick Wohlgemuth, North Bellmore, N.Y.

[73] Assignee: Superseal Corporation, Condado, Puerto Rico

[21] Appl. No.: 517,065

[22] Filed: Aug. 21, 1995

[51] Int. Cl.[6] ..... B65D 41/47

[52] U.S. Cl. ..... 215/256; 215/330; 215/901

[58] Field of Search ..... 215/250, 256, 215/901, 318, 254, 329–331; 270/270, 276

[56] References Cited

U.S. PATENT DOCUMENTS

| | | | |
|---|---|---|---|
| 3,980,195 | 9/1976 | Fillmore | 215/256 |
| 4,320,843 | 3/1982 | Dubach | 215/256 |
| 4,625,876 | 12/1986 | Bullock, III | 220/276 X |
| 4,759,465 | 7/1988 | Landis | 215/256 X |
| 4,798,301 | 1/1989 | Bullock et al. | 215/256 |
| 4,801,032 | 1/1989 | Crisci | 215/256 |
| 5,100,011 | 3/1992 | Maietta | 215/256 |
| 5,207,340 | 5/1993 | Cochrane | 215/256 |
| 5,213,224 | 5/1993 | Luch | 215/256 |
| 5,307,946 | 5/1994 | Molinaro | 215/256 X |
| 5,456,376 | 10/1995 | Luch et al. | 215/256 |
| 5,480,045 | 1/1996 | Molinaro et al. | 215/256 |

FOREIGN PATENT DOCUMENTS

| | | | |
|---|---|---|---|
| 1026269 | 2/1978 | Canada | 215/256 |
| 1016084 | 10/1952 | France | 215/256 |
| 681404 | 10/1952 | United Kingdom | 215/256 |

*Primary Examiner*—Allan N. Shoap
*Assistant Examiner*—Nathan Newhouse
*Attorney, Agent, or Firm*—Hoffmann & Baron

[57] ABSTRACT

In combination, a container having an opening and a cap adapted for closing the opening and having a tamper-indicating ring frangibly connected thereto for denying removal of the cap while the ring is connected thereto, wherein the ring comprises a plurality of pull-tabs to facilitate disconnection from the cap, the pull-tabs being symmetrically disposed about the ring such that one or more is convenient to right-handed users and one or more of the remaining is convenient to left-handed users, regardless of the cap's rotational position relative to the user.

11 Claims, 11 Drawing Sheets

CONTAINER CLOSURE HAVING PERIPHERAL TAMPER-INDICATOR

FIELD OF THE INVENTION

The present invention is related to caps for use with containers, specifically to caps which provide tamper-indication for evidence that the cap has previously been removed.

BACKGROUND OF THE INVENTION

Containers having removable caps are used ubiquitously and have been for many years. In many instances, containers are provided with means to indicate that the cap has been removed since the container was originally filled. Such tamper-indication provides the intending user with instant evidence of the freshness or safety of the goods within. This may be vitally important in containers which hold food or medicine. Recent occurrences of product tampering wherein foods and medicines have been illegally altered and poisoned have made the inclusion of tamper-indication means on many food and medicine containers a required feature.

Such tamper-indicators have been provided in many forms, from the paper seals permanently taped over liquor bottles to the elaborate packaging of many over-the-counter medicines. Caps for bottles which contain liquids such as soda, spring water, milk, and such, are often provided with frangible elements as integral portions of the cap which must be torn or separated from the cap before the cap can be removed. These frangible elements usually include means to positively secure the cap to the bottle so that the cap cannot be removed while the frangible element is still attached. Once removed, the cap can be snapped or screwed off of the bottle, but potential later users can instantly recognize that the frangible element is no longer integral with the cap, or no longer present at all, and can thereby ascertain the risk of using or consuming the remaining contents.

Such frangible tamper indicators have been offered countless times throughout the prior art. Two types of such indicators are most common in the recent prior art; those having a screw-off cap with a continuous annular frangible ring that remains on the bottle after opening, and those having a snap-off or screw-off cap and a non-continuous removable frangible ring including a pull-tab to initiate tearing and removal of the ring from the cap along a groove or perforation.

Those of the former type with the continuous frangible ring are generally provided in a molded plastic or stamped sheet-metal cap. The frangible ring is adapted to engage the bottle neck and prevent axial movement of the cap from the bottle. Simultaneous removal of the cap from the bottle and the ring is accomplished by twisting the cap to unscrew it with enough force to separate the cap from the ring. Because the axial separating forces are distributed fully around the circumference of the perforation or groove, the forces must be quite high to cause separation. The engagement of the ring to the bottle must be secure enough to withstand those separating forces and maintain the ring on the bottle, or the tamper-indication will be overcome. The perforation or groove must be precisely sized to allow separation with practical ease while having enough strength to maintain the sealing engagement of the cap and bottle. Unfortunately, the fine balance between the various and variable components is difficult to maintain. Such caps are often too difficult for many users, such as the elderly, to twist-off. The pull-tab type ring has therefore become one of the most common types used in low-cost containers and containers often used by the elderly, such as in blow-molded plastic milk bottles.

Those tamper-indicators of the latter type with a pull-tab have become so popular in main part because the pull-tab provides an easy means to start the separation of the ring from the cap, requiring very little physical strength on the part of the user. The pull-tab provides significant advantage in allowing initiation of the tear at a localized section of the groove, then provides a convenient handle for pulling the ring away from the cap around the groove. Such tamper-indicators have been the subject of numerous patents, such as U.S. Pat. No. 5,190,178.

In U.S. Pat. No. 5,190,178, the disclosed threaded cap and neck configuration must be rotated for removal and re-application of the cap. The frangible tamper-indicator includes voids which are engaged by lugs in the neck collar to prevent such rotation. Because the voids and lugs must be aligned, and the threads must be aligned, prior to assembly at initial bottling, the singular pull-tab of the ting serves as an orientation feature which is used by an orientation machine to determine the cap's original rotational position and to then re-orient the cap into the desired rotational position for assembly. As is disclosed, the pull-tab must be a singular and significant enough discontinuation from the cap's round shape to allow its location by the orientation machine.

One noteworthy advantage of the continuous ring, however, is that it is tolerant of the direction from which the bottle is approached and the cap is removed by the user. The bottle can be taken in hand and the cap can be grasped and twisted regardless of the rotational position of the cap. Whereas, with the pull-tab type ring, the cap most be positioned or the bottle must be rotated so that the pull-tab is convenient for grasping. This is particularly evident in bottles having handles such as blow-molded plastic milk bottles. It is most comfortable and convenient that such bottles are held by the handle with the secondary hand, the left hand in most cases, and the pull-tab is grasped with the primary hand, the right hand in those cases. Depending on the rotational position of the pull tab on the bottle relative to the handle, the pull-tab may be inconvenient to grasp while holding the handle as such. The pull-tab may be convenient to right-handed users but not to left-handed users, or vice-versa. If the pull tab is positioned rotationally opposite the handle, it is inconvenient to all users. Rotation of the pull-tab to a desirable position on the bottle is difficult and inconvenient at best, and likely impossible. On a screw-off cap, it is impossible. The pull-tab position is determined by the relative rotational position of the cap and bottle at the bottling plant during loading of the bottle.

In order to position the pull-tab during bottling for convenient access by most users, an orientation machine may be employed to locate the pull-tab for orienting the cap as earlier mentioned, and to thereby position the pull-tab relative to the handle for easy access by right-handed persons. However, the expense and complication of employing such a machine in the bottling process is prohibitive, and the cap is still not easily accessed by left-handed users, who represent a significant portion of the using population. Also, the pull-tab must again be a singular and significant enough discontinuation from the cap's round shape to allow its location by the orientation machine, or else an additional such orientation feature must be provided.

The bottling and container industries today suffer from the lack of an easy-to-assemble, tamper-indicating cap which is equally convenient to both the left-handed and the right-handed user while being easy for that user to remove.

OBJECTS AND SUMMARY OF THE INVENTION

The present invention is a tamper-indicating container cap comprising a frangible tamper-indication ring having a plurality of pull-tabs disposed thereabout. The pull-tabs are positioned about the cap such that one pull-tab on the assembled but not-yet removed cap is always convenient to a right-handed user, and one is always convenient to a left-handed user, regardless of the direction from which the cap is approached. Adjacent each pull-tab is a frangible tear-initiation groove which is adapted to allow instant breakage of the continuity of the frangible ring by pulling on that pull-tab. Subsequent pulling on that pull-tab causes tearing along an annular tear groove until the frangible ring is separated from the cap. The annular tear groove is adapted such that it will tear along it's entire length while the remaining tear-initiation grooves, adjacent the alternate pull-tabs, will not tear. In this way the frangible ring is wholly removed in a single operation by the user.

It is the object of the present invention to provide a cap having a tamper-indication ring which is conveniently accessed and easily removed by both right-handed and left-handed users.

It is a further object to provide such a cap which is inexpensive to manufacture.

It is a further object to provide such a cap which can be positioned automatically during assembly regardless of the relative rotational position of the cap to the container.

Further objects and advantages of the present invention will be best appreciated and more fully understood in reference to the herein described preferred embodiment and the appended drawings, of which the following is a brief description.

DESCRIPTION OF THE PREFERRED EMBODIMENT OF THE INVENTION

Figure 1:
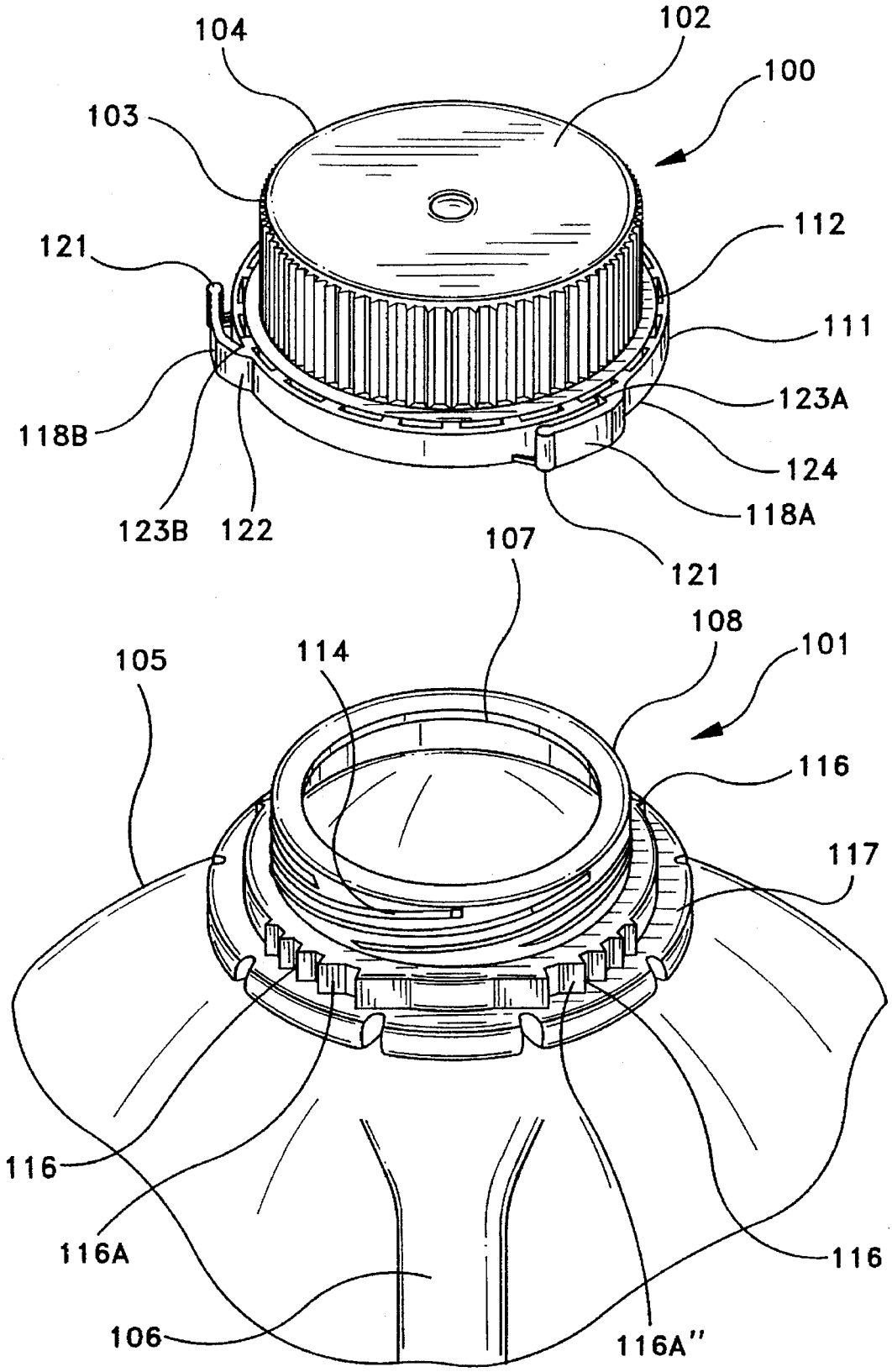
FIG. 1 is an exploded perspective view of a cap and a container in accordance with the present invention.
Figure 2:
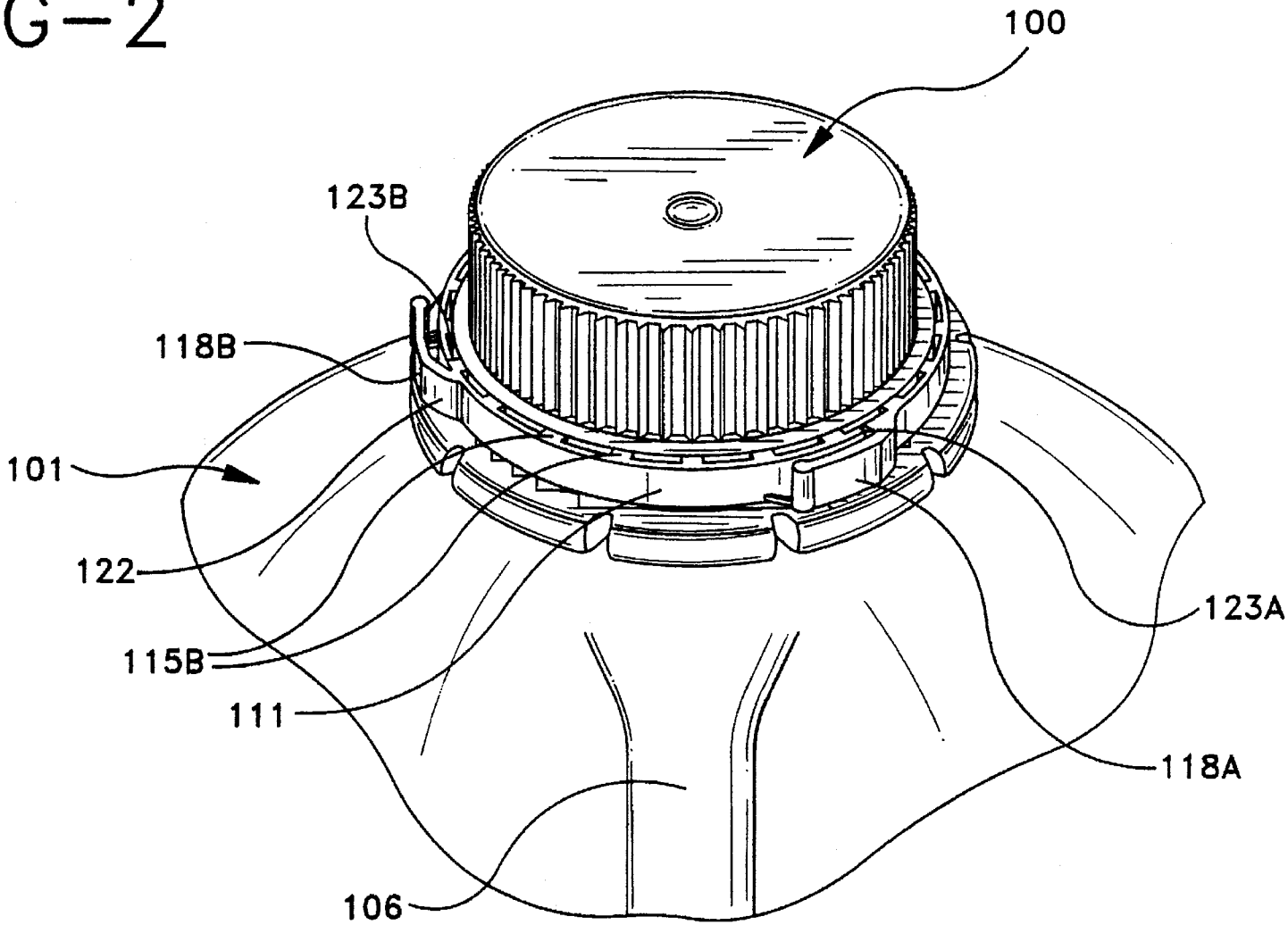
FIG. 2 is an assembled perspective view of the cap and container of FIG. 1.
Figure 3:
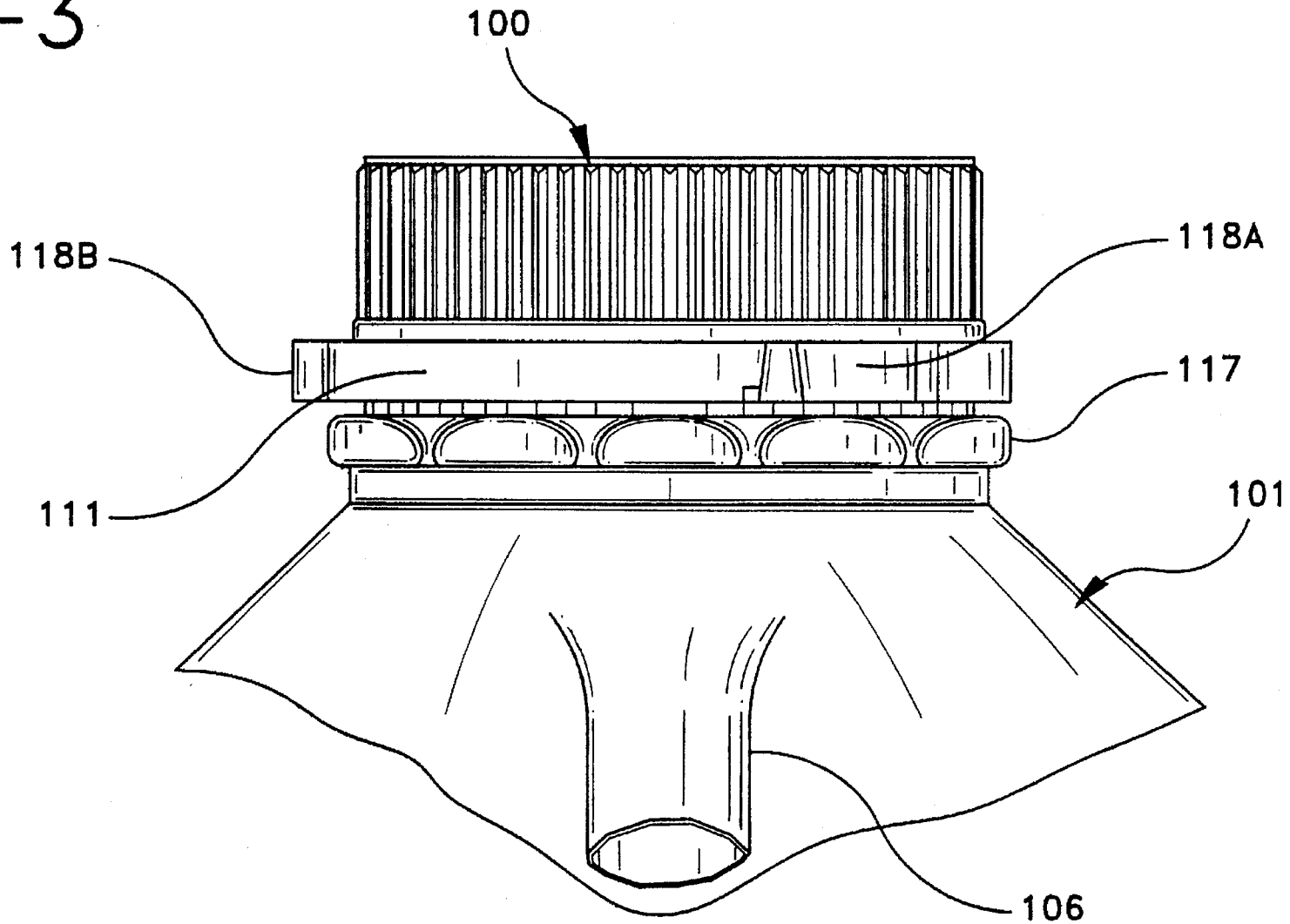
FIG. 3 is an assembled side view of the cap and container of FIG. 1.
Figure 4:
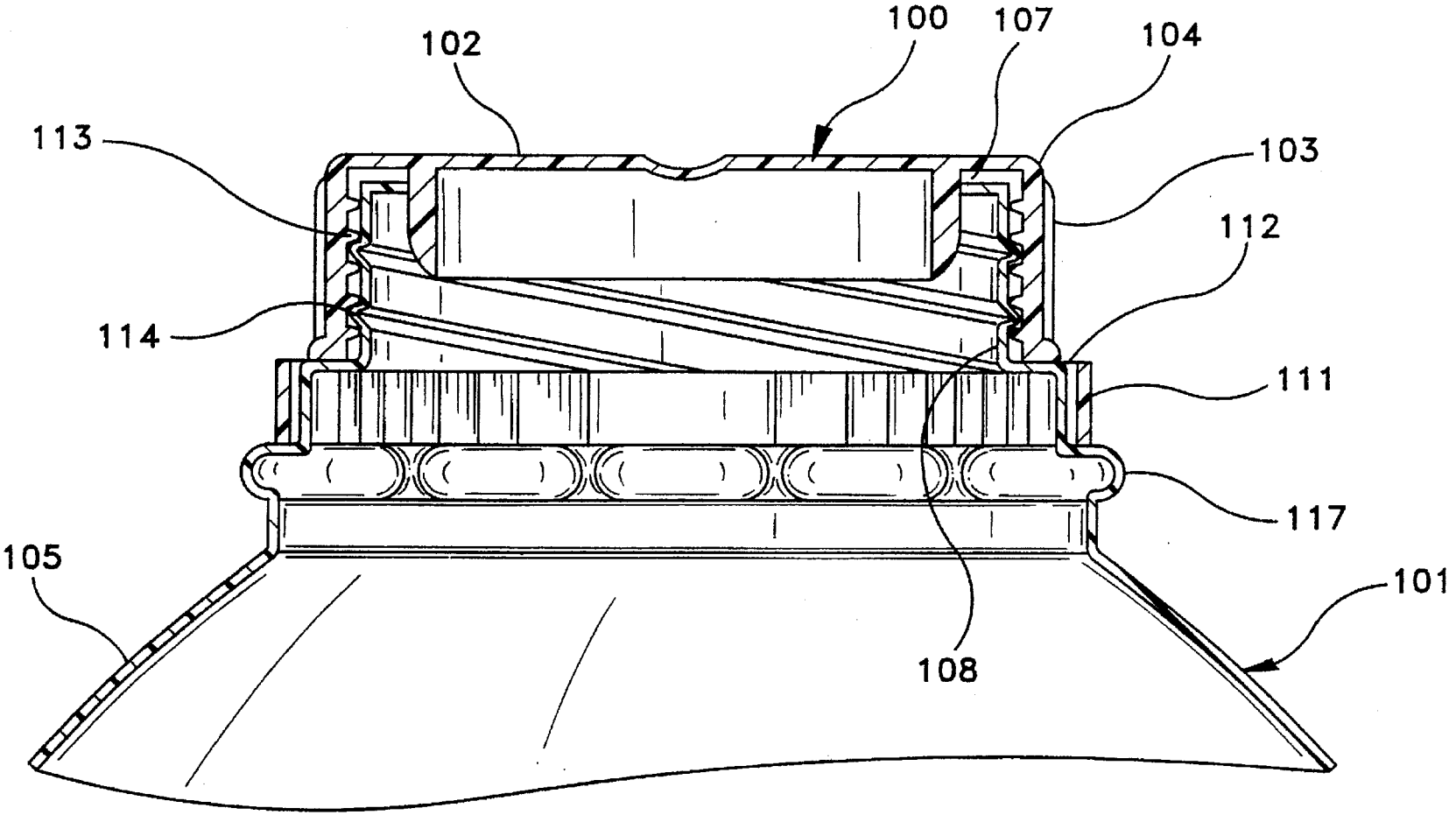
FIG. 4 is a cross-sectional side view of the cap and container of FIG. 1.

The preferred embodiment of the present invention is depicted in FIGS. 1 through 9. The embodiment comprises a cap 100 and a container 101.

The cap 100 is of the screw-off type and comprises a plano-circular top 102 having a cylindrical top skirt 103 depending downwardly from the top's periphery 104. The container 101 is a typical blow-molded bottle 105 having a handle 106 and having a top opening 107 in a centrally disposed upper neck 108. The plano-circular cap top seals against the neck opening to close the container. A generally cylindrical frangible ring 111 depends downwardly from and is connected to the cap's top skin at annular tear groove 112. The top skirt 103 further includes helical internal threads 113 which engage mating external threads 114 on the bottle neck. The frangible ring 111 includes equally positioned internal lugs 115 which engage equally positioned external lugs 116 disposed in the collar 117 of the neck. As clearly shown in FIG. 7, the internal lugs 115 include a lower edge 115A which is tapered to a point and an upper rectangular-shaped portion 115B. The upper portion 115B includes an inner edge which is connected to a lower edge of the top skirt 103 thereby forming the annular tear groove 112 as specifically shown in FIGS. 1, 2 and 9. The spaces between the lugs leave a plurality of openings in the annular tear groove 112. Assembly of the cap and neck is accomplished by direct axial application of the cap onto the neck. During assembly, the cap threads slip past and snap over the neck threads. The frangible ring internal lugs 115 fit between the adjacent neck external lugs 116, and the lugs become fully engaged as the cap seals the neck opening 107 to deny relative rotation of the cap and bottle. The tapered lugs aid in aligning the cap with the external lugs 116 disposed in the collar 117 of the neck of the container. Because rotation of the cap is denied, unscrewing and removal of the cap is denied.

Figure 8:
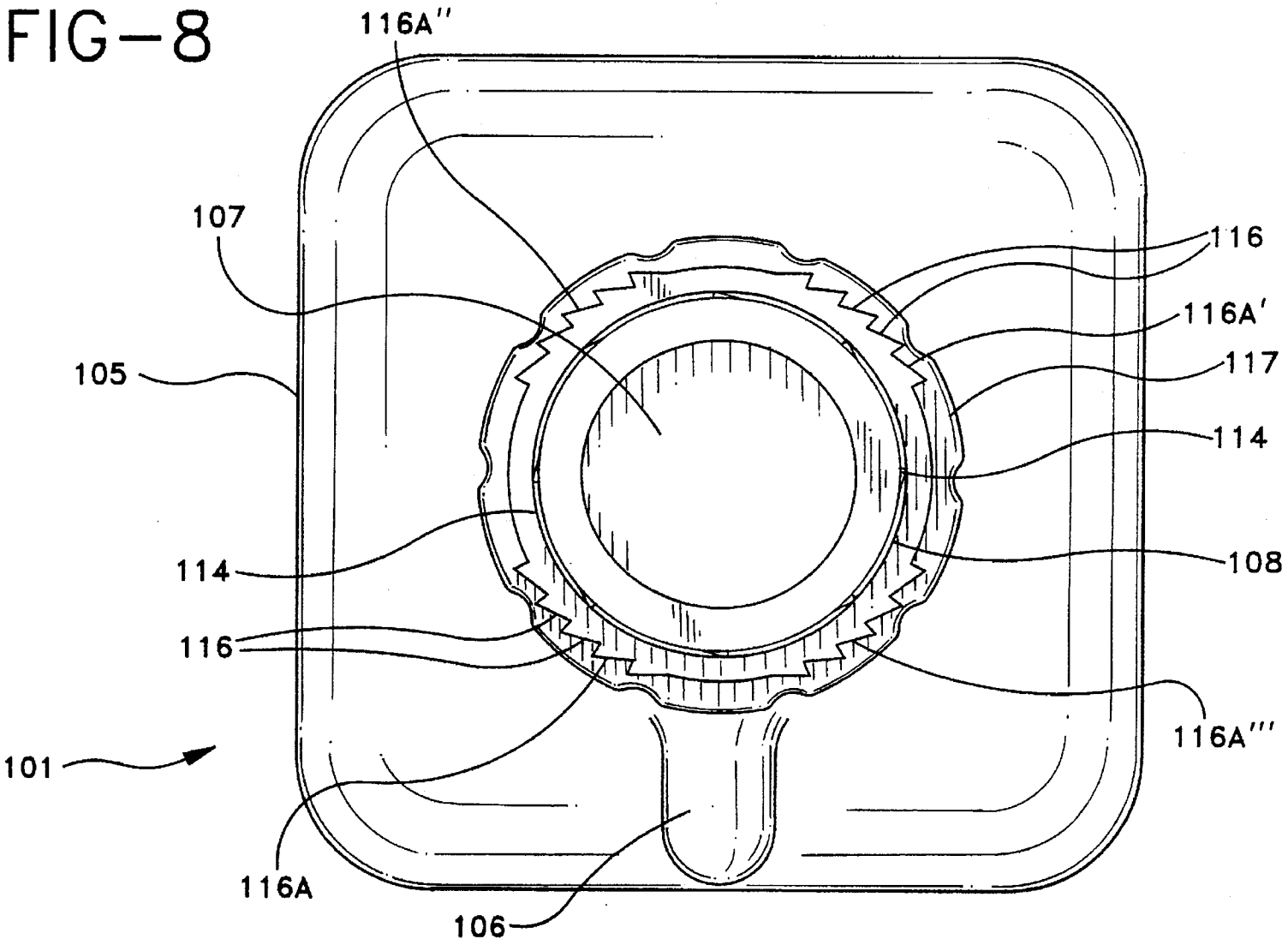
FIG. 8 is an top view of the container of FIG. 1.

As clearly shown in FIG. 8, the neck of the container includes external lugs 116 formed in two pairs of lugs 116A, 116A' and 116A", 116A'", respectively. More specifically, the pair of lugs 116A, 116A' are formed of five ratcheted teeth each, each set of lugs in the pair being ratcheted or sloped in the same direction. The pair of lugs 116A", 116A'" are also formed of five ratcheted teeth each; however, each set of lugs in the pair are ratcheted or sloped in the same direction and opposite to lugs 116A, 116A'. This oppositely sloped ratcheting of the teeth denies rotation of the cap in either direction once axially displaced onto the neck of the container.

Figure 5:
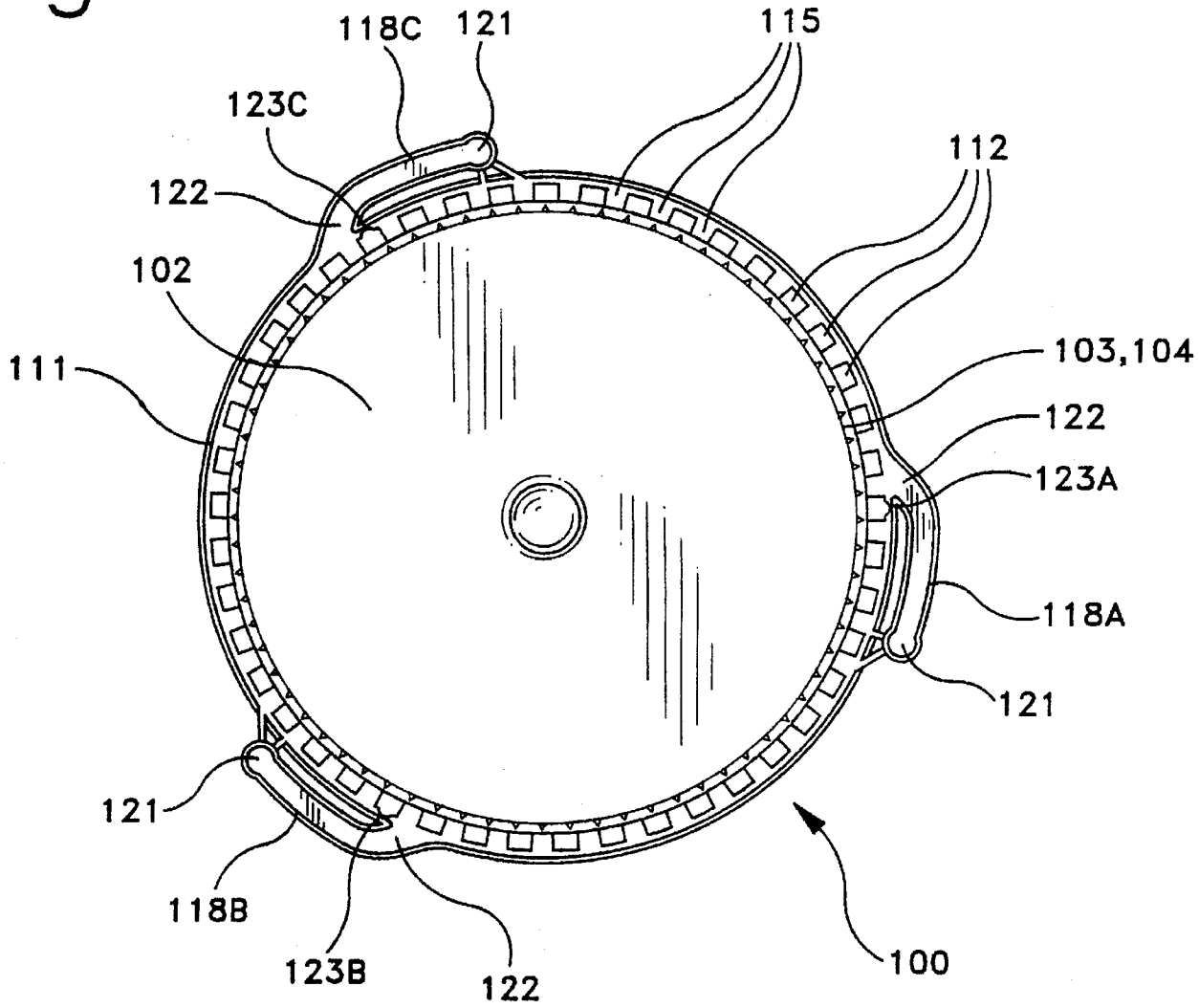
FIG. 5 is an top view of the cap of FIG. 1.
Figure 6:
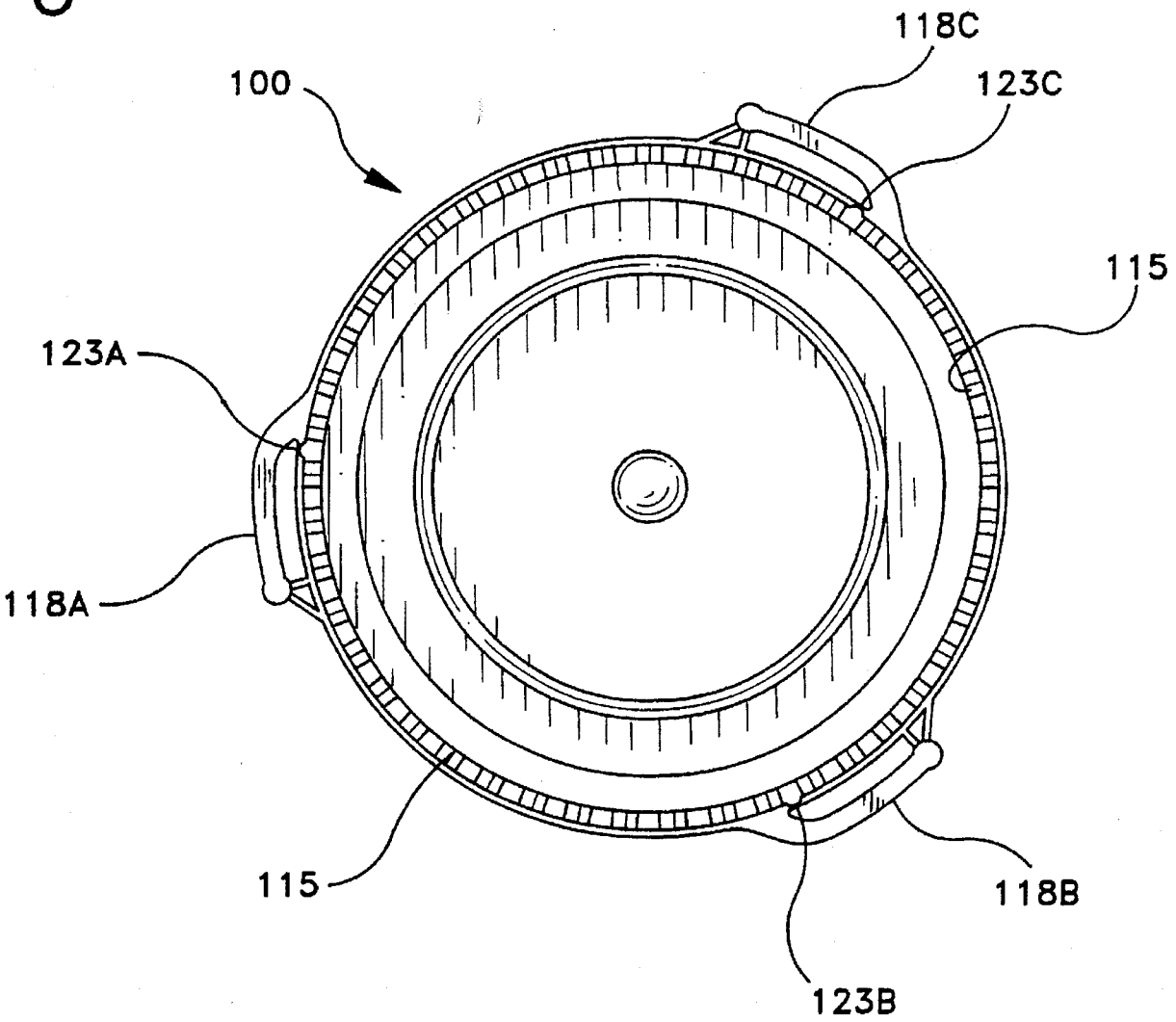
FIG. 6 is an bottom view of the cap of FIG. 1.
Figure 7:
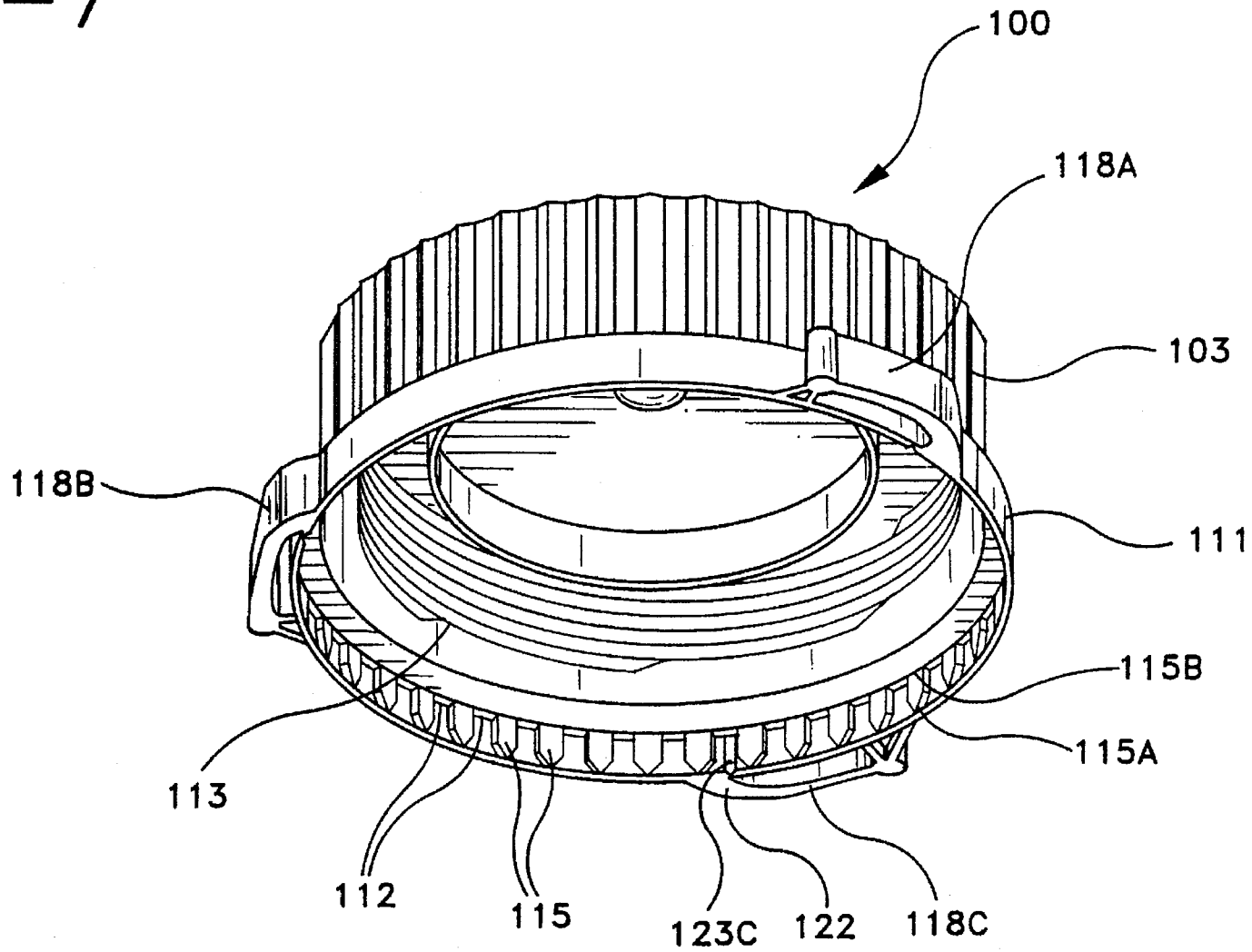
FIG. 7 is an bottom perspective view of the cap of FIG. 1.
Figure 9:
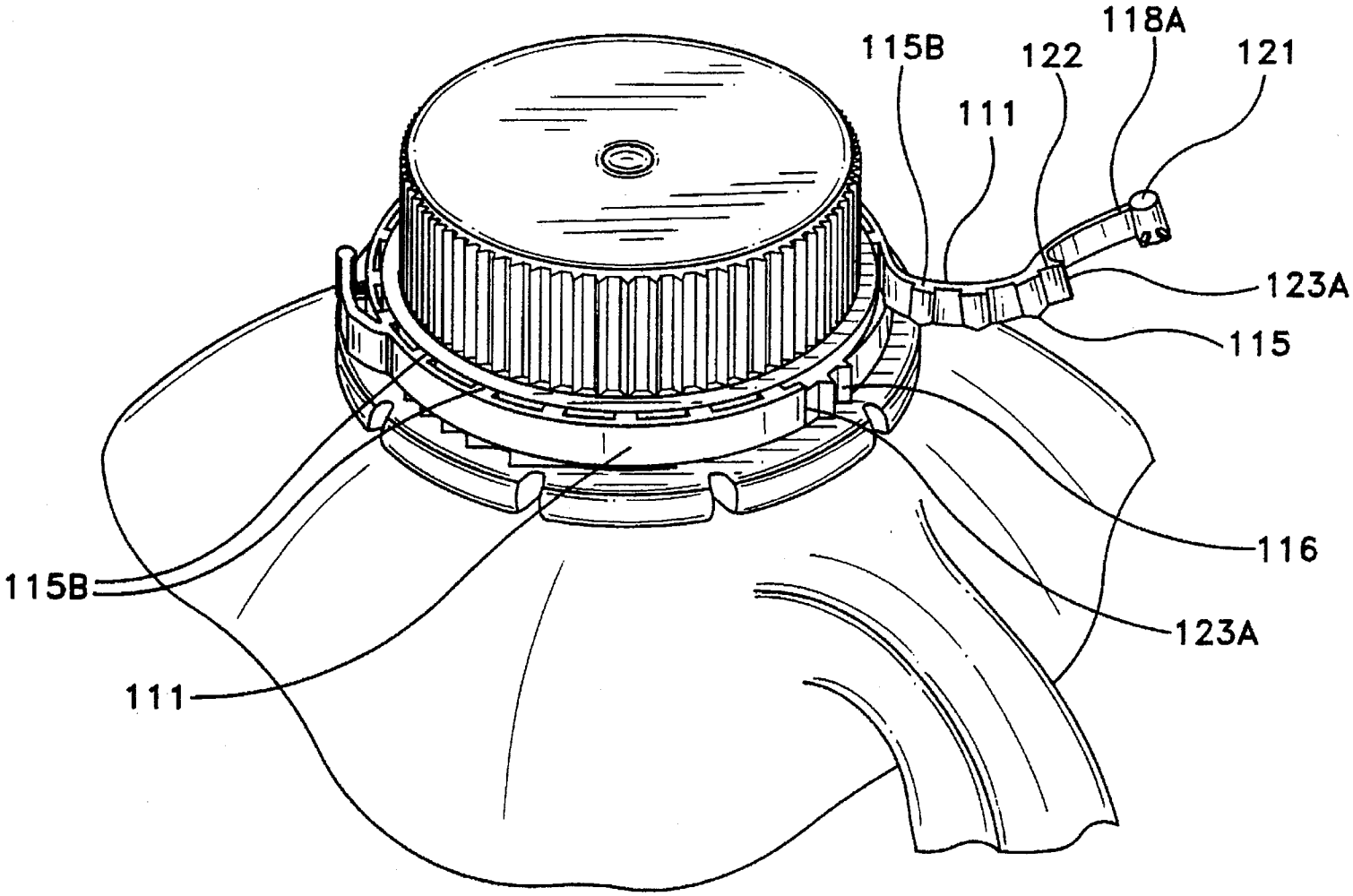
FIG. 9 is an assembled perspective view of the cap and container of FIG. 1 having the tamper-indicating ring partially removed.

The frangible ring 111 further includes three pull-tabs 118A, 118B, and 118C, equally positioned about the circumference of the cap. Each pull-tab includes an easily graspable pinch end 121 which allows a user to firmly grasp the tab for pulling. Adjacent each pull-tab is a tear-initiation groove, 123A, 123B, and 123C, which extends vertically across the frangible ring from its lower edge 124 to the annular tear groove. Each tear-initiation groove is positioned and adapted such that radial/tangential pulling on the adjacent pull-tab at the tab's pinch end will provide a tearing force at the tear-initiation groove which tears the groove and breaks the frangible ring from the lower edge to the annular tear groove. The annular tear groove is adapted such that continued pulling on the pinch end, as depicted in FIG. 9, will cause tearing fully around the annular tear groove. The tear-initiation grooves are somewhat stronger than the annular tear groove, so that pulling on one of the pull-tabs, such as pull-tab 118A depicted, will break the adjacent tear-initiation groove 123A, and then the annular tear groove all around with the remaining tear-initiation grooves, 123B and 123C, remaining intact. As shown in FIGS. 5 and 7, pull-tabs 118& 118B, and 118C are strategically located along the frangible ring so that the connection end 122 of the pull-tab opposite the graspable pinch end 121, flares at the connection point with the frangible ring. Furthermore, the flared portion is positioned directly opposite an internal lug 115 to provide a stronger section on the frangible ring for tearing the ring off the cover. Accordingly, the pull-tab is securely connected to the frangible ring and will not break off during removal of the frangible ring. Furthermore, the tear initiation grooves 123A, 123B and 123C, are strategically positioned between internal lugs and adjacent to the lug opposite the flared connection end of the pull-tab between the connection end 122 and the pinch end 121. Removal of the cap's frangible ring allows rotation of the cap relative to the neck and the cap can then be unscrewed and removed. Removal of the frangible ring further provides tamper-indication by alerting the user that the cap has likely been removed since initial assembly.

Re-attachment of the cap is accomplished by rotational screwing, wherein the sealing system re-engages with each subsequent re-attachment, absent, of course, the tamper-indicating frangible ring.

Figure 10:
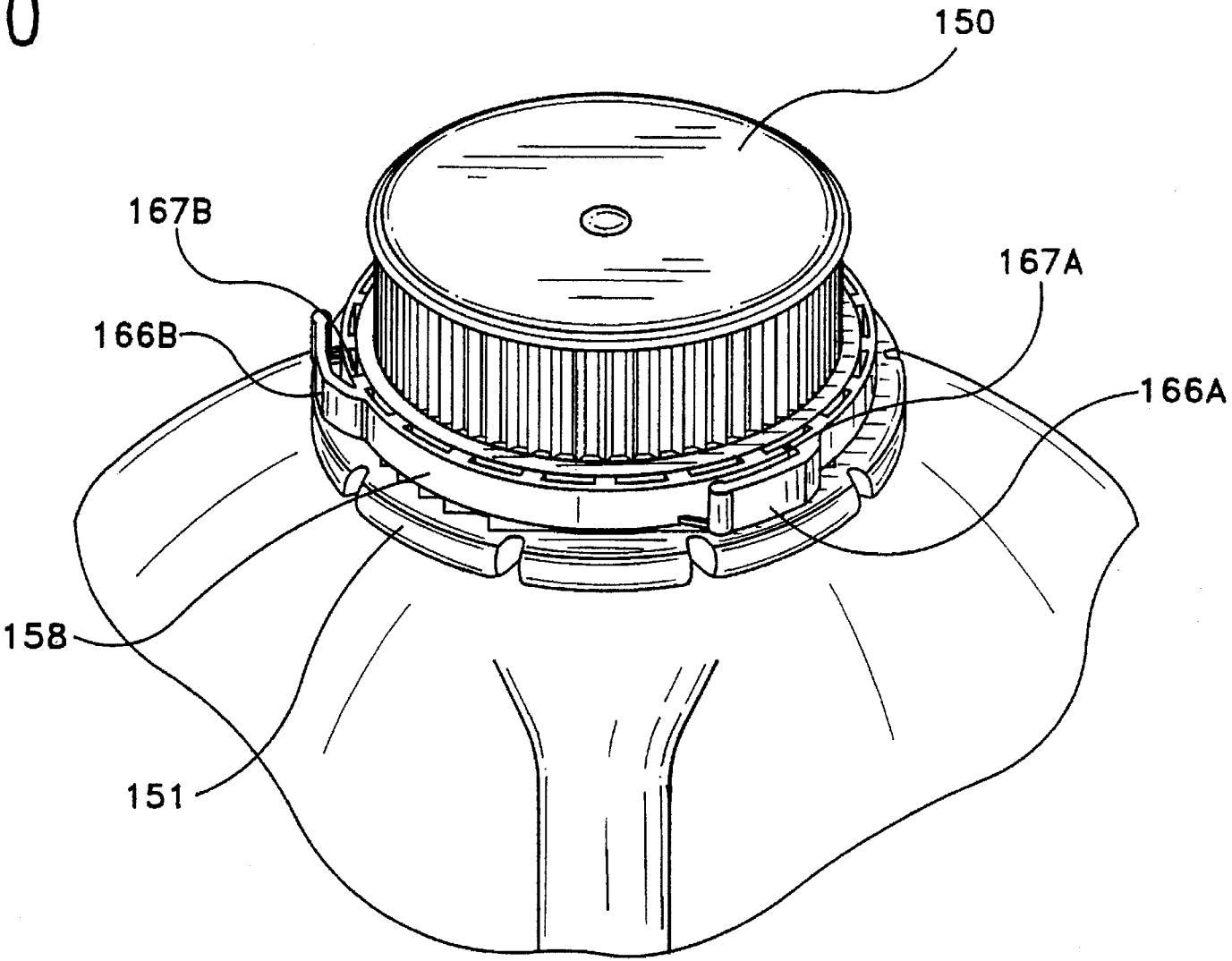
FIG. 10 is an assembled perspective view of an alternate embodiment of a cap and container according to the invention.
Figure 11:
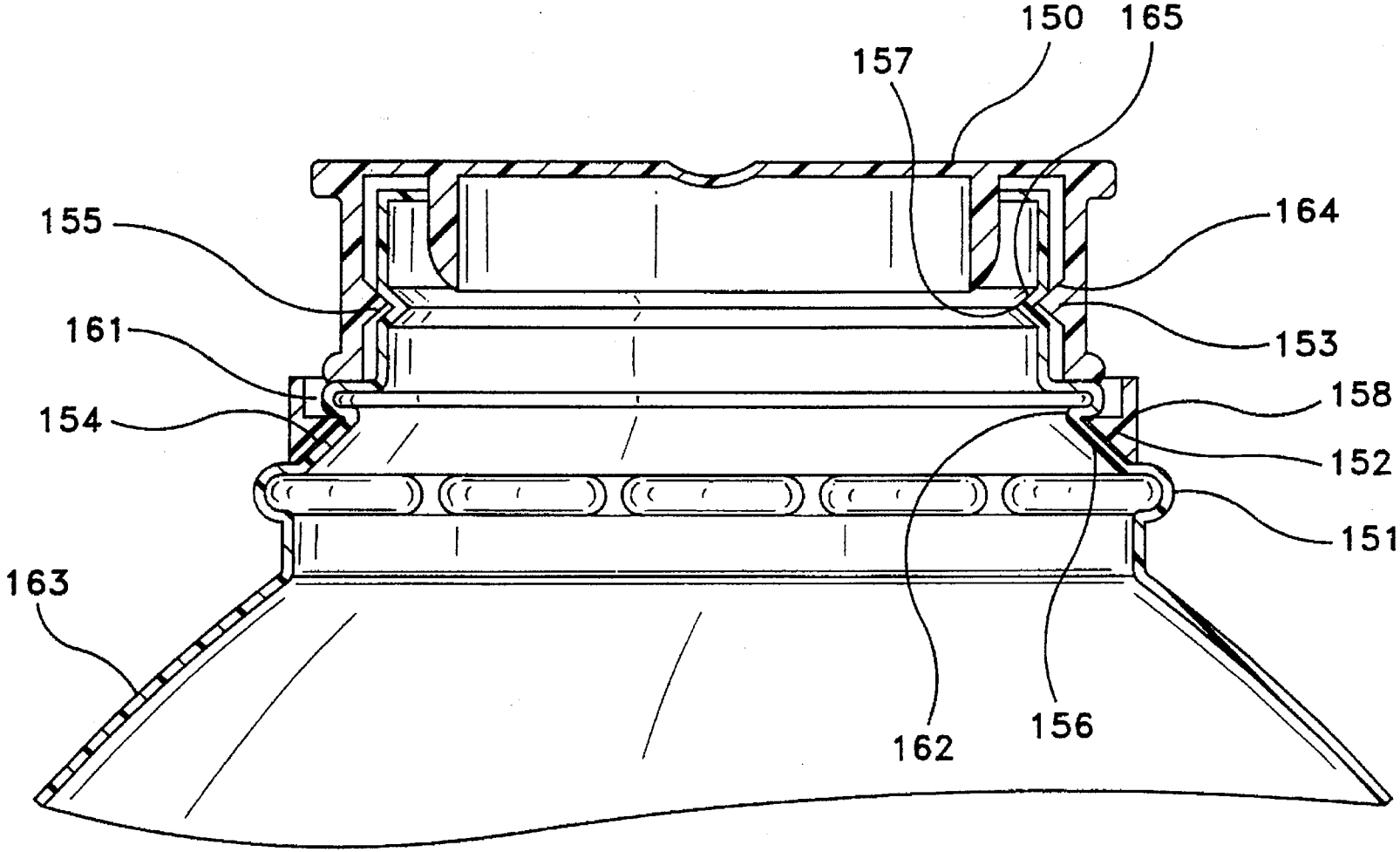
FIG. 11 is an assembled cross-sectional side view of the cap and container of FIG. 10.

In FIGS. 10 and 11, an alternate embodiment of the invention is offered in which the cap 150 and neck 151 are of the snap-off type. The threads, lugs, and external lugs of the primary embodiment of FIGS. 1 through 9 are not present, but are replaced by mating annulations in the cap and neck. First internal annulation 152 and second internal annulation 153 of the cap are shaped and adapted with angled lead-in surfaces, 154 and 155, to snap-over and engage first external annulation 156 and second external annulation 157, respectively, of the neck during axial assemble. The first internal annulation is disposed on frangible ring 158. The first internal and first external annulations include horizontal engagement surfaces, 161 and 162, which positively axially interlock the cap and neck and deny axial removal of the cap from the bottle 163. The second internal and second external annulations include angled engagement surfaces, 164 and 165, which provide moderately secure axial attachment, but allow relatively easy axial removal and reattachment. Three pull-tabs, 166A, 166B, and 166C, are provided, with corresponding tear-initiation grooves, 167A, 167B, and 167C, to allow frangible ring removal similar to that provision of the primary embodiment. However, in the present embodiment, removal of the frangible ring allows axial removal of the cap, by "snapping" the cap past the moderate engagement of the remaining second internal and external annulations.

Those skilled in the art will recognize that there are many variations of the invention that are within the scope of the invention, therefore, the invention is to be defined only by the limitations and the equivalents thereof which the following claims set forth.

I claim:

1. In combination, a blow-molded plastic container having an opening, a handle and a cap, said cap comprising a cover portion for closing said opening and an integral tamper-indicating ring frangibly connected thereto at a tear line, said cover portion and said container including cooperative means for allowing removable and replaceable engagement therebetween, said frangible ring and said container including cooperative means for denying removal of said cover portion unless said cover portion and ring are disconnected at said tear line, said cooperative means comprising mating lugs disposed in said frangible ring and said container, wherein the mating lugs on the container comprises first and second pairs of ratcheted lugs, the first pair of ratcheted lugs being sloped in a first direction and the second pair of ratcheted lugs being sloped in a second direction opposite to the first direction, and wherein said frangible ring comprises three pull-tabs having a grasping end and a connection end coupling the pull-tabs to the frangible ring, the pull-tabs facilitating complete disconnection of said ring from said cover portion, and three tear-initiation grooves transversing said ring, each adjacent one of said pull-tabs, said pull-tabs and said tear-initiation grooves being symmetrically disposed about said ring such that the connection ends of the pull-tabs are spaced 120° apart along the frangible ring, whereby one or more of said pull-tabs is convenient to right-handed users and one or more of said remaining pull-tabs is convenient to left-handed users, regardless of said cap's rotational position relative to said container handle and said user.

2. The combination of claim 1 wherein said cooperative means for allowing removable and replaceable engagement comprise mating helical threads disposed in said cover portion and said container.

3. The combination of claim 1 wherein said cooperative means for denying removal of said cover portion comprise first mating annulations disposed in said frangible ring and said container.

4. The combination of claim 3 wherein said cooperative means for allowing removable and replaceable engagement comprise second mating annulations disposed in said cover portion and said container.

5. The combination of claim 1, wherein the tear line comprises an upper portion of said mating lugs in said frangible ring having an inner edge coupled to said cover portion.

6. The combination of claim 1, wherein the first and second pair of ratcheted lugs each comprises two sets of a plurality of lugs, each set of lugs being positioned approximately 180° from the other set in the pair.

7. The combination of claim 1, wherein the pull-tabs are positioned on an external surface of the frangible ring such that the connection end of the pull-tab is aligned with a lug on an internal surface of the frangible ring.

8. In combination, a blow-molded plastic container having a handle, a generally cylindrical neck surrounding an opening, and a cap, said cap comprising a cover portion having a closed circular top for closing said opening, a generally cylindrical skirt depending downwardly from said circular top for surrounding said neck, and an integral circular tamper-indicating ring frangibly connected therebelow at a continuous tear line, said neck externally threaded and said skirt internally threaded for removable and replaceable engagement of said cover portion to said container by relative rotation therebetween, said neck externally lugged and said frangible ring internally lugged for rigid rotational engagement of said cap to said container so that said relative rotation between said cover portion and said container is denied, and therefor removal of said cover portion from said opening is denied, unless said cover portion and said ring are disconnected at said tear line, wherein the external lugs on the container comprises first and second pairs of ratcheted lugs, the first pair of ratcheted lugs being oriented in a first direction and the second pair of ratcheted lugs being oriented in a second direction opposite to the first direction, and wherein said frangible ring comprises three pull-tabs and three tear-initiation grooves, each tear-initiation groove disposed adjacent a corresponding pull-tab connection portion and traversing said ring, and said ring is adapted such that a radial or tangential pulling force on one of said pull-tabs breaks said corresponding tear-initiation groove and opens said ring and thereby facilitates tearing of said tear line and complete disconnection of said ring from said cover portion, said said pull-tab connection portions being circumferentially disposed symmetrically 120° apart about said ring such that one or more of said pull-tabs is convenient to right-handed users and one or more of said remaining pull-tabs is convenient to left-handed users, regardless of said cap's rotational position relative to said container handle and said user.

9. The combination of claim 8, wherein the tear line comprises an upper portion of said lugs in said frangible ring having an inner edge coupled to said cylindrical skirt of said cap.

10. The combination of claim 8, wherein the first and second pair of ratcheted lugs each comprises two sets of a plurality of lugs, each set of lugs being positioned approximately 180° from the other set in the pair.

11. The combination of claim 8, wherein the pull-tabs are positioned on an external surface of the frangible ring such that the connection end of the pull-tab is aligned with a lug on an internal surface of the frangible ring.

* * * * *